US005513613A

United States Patent [19]

Taylor et al.

[11] Patent Number: 5,513,613

[45] Date of Patent: May 7, 1996

[54] AUTOMOTIVE FUEL RAIL END CLOSURE DEVICE WITH TEMPERATURE SENSOR FOR RETURNLESS FUEL SYSTEM

[75] Inventors: James D. Taylor, Temperance; Robert E. Wattleworth, Canton; James L. Creehan, Livonia; Anthony M. Horvath, Temperance, all of Mich.

[73] Assignee: Ford Motor Company, Dearborn, Mich.

[21] Appl. No.: 270,556

[22] Filed: Jul. 15, 1994

[51] Int. Cl.[6] ..... F02M 37/04

[52] U.S. Cl. ..... 123/456; 123/494; 123/497; 123/468

[58] Field of Search ..... 123/468, 469, 123/470, 467, 497, 456, 494, 381; 73/119 A

[56] References Cited

U.S. PATENT DOCUMENTS

| | | | |
|---|---|---|---|
| 3,283,844 | 1/1974 | Gural | 123/456 |
| 4,125,093 | 11/1978 | Platzer | 123/497 |
| 4,345,565 | 8/1982 | Bottoms | 123/492 |
| 4,474,159 | 10/1984 | Katnik . | |
| 4,519,368 | 5/1985 | Hudson, Jr. . | |
| 4,570,600 | 2/1986 | Atkins et al. . | |
| 4,601,275 | 7/1986 | Weinand . | |
| 4,845,393 | 7/1989 | Burgess | 123/497 |
| 4,899,712 | 2/1990 | De Bruyn et al. . | |
| 4,922,880 | 5/1990 | Seibt | 123/497 |
| 4,922,958 | 5/1990 | Lemp . | |
| 5,013,222 | 5/1991 | Sokol | 123/497 |
| 5,022,372 | 6/1991 | Imura | 123/456 |
| 5,092,300 | 3/1992 | Imoehl | 123/456 |
| 5,168,856 | 12/1992 | Lorraine . | |
| 5,168,857 | 12/1992 | Hickey . | |
| 5,197,435 | 3/1993 | Mazur et al. . | |
| 5,233,963 | 8/1993 | Gregorius et al. . | |
| 5,237,975 | 8/1993 | Betki et al. . | |

*Primary Examiner*—Carl S. Miller
*Attorney, Agent, or Firm*—David B. Kelley; Roger L. May

[57] ABSTRACT

A fuel supply manifold in a returnless fuel system for supplying fuel to an internal combustion engine has a fuel rail with a first end having a first opening and a second end having a second opening. A one piece end plug, which fits into the first opening to provide closure thereof, has a fuel hose connector with a fuel inlet therethrough to pass fuel to the fuel rail and a fuel temperature sensor in close proximity to the fuel inlet. The one piece end plug also has an electrical connector casing for receiving an electrical connector to conduct the fuel temperature signal to a remote location for processing. A flange on the end plug attaches to the fuel rail with a pair of bolts, and a core with O-rings thereon extends from the flange for locating and sealing the end plug to the fuel rail. The second end is capped so that fuel may not flow therethrough.

3 Claims, 3 Drawing Sheets

AUTOMOTIVE FUEL RAIL END CLOSURE DEVICE WITH TEMPERATURE SENSOR FOR RETURNLESS FUEL SYSTEM

FIELD OF THE INVENTION

The present invention relates to automotive fuel injection systems, and, more particularly, to an automotive fuel rail for a returnless fuel system having an end closure device with a fuel temperature sensor.

BACKGROUND OF THE INVENTION

Conventional fuel injection systems utilize a fuel pump to provide fuel to a fuel injection supply manifold having a fuel rail which carries fuel to a plurality of fuel injectors. A pressure regulator is mounted in the fuel flow path so as to maintain the fuel pressure in the rail at approximately 40 psi greater than engine intake manifold vacuum. The pump, typically mounted in the fuel tank, runs at a constant speed and may deliver, for example, 90 liters per hour. When idling, the engine needs only about 3 liters per hour and, therefore, 87 liters per hour must be returned to the fuel tank through a return line. This returned fuel usually has an increased temperature as a result of being routed to the engine and thus frequently evaporates upon reaching the relatively lower pressure and temperature of the fuel tank. The fuel vapor so generated either remains in the tank until vented to atmosphere, which potentially creates environmental problems, or until captured in a vapor storage container, such as a carbon canister, which requires additional manufacturing expense.

In any case, the problems associated with fuel vapor generation in conventional fuel systems have led fuel system designers to develop a returnless fuel supply system, such as that disclosed in U.S. Pat. No. 5,237,975 (Betki et al.), assigned to the assignee of the present invention. In such a system, fuel rail pressure is controlled for precise fuel mass flow to the injectors at both normal and elevated engine temperatures by varying fuel pump speed as a function of assorted variables, including fuel temperature. As a result, the fuel temperature must be accurately measured without interfering with fuel flow in the rail.

The present invention provides a means to measure fuel temperature without obstructing fuel flow while also providing an end closure for the rail with a fuel inlet, all in a unitary component. An end closure device is required since molding, extruding, or forging of fuel rails typically leaves an opening or aperture at the longitudinal ends of the fuel rail. These openings are usually closed with a cap or plug, as shown in U.S. Pat. No. 5,197,435 (Mazur et al.), U.S. Pat. No. 4,570,600 (Atkins, et al.) and U.S. Pat. No. 4,601,275 (Weinand), to prevent fuel leakage from the rail. Such caps may have a barbed type hose connection in the end cap, such as disclosed in U.S. Pat. No. 4,474,159 (Katnik), with a pressure regulator inserted on the other end of the rail. Other end closure devices may have a fuel inlet nipple brazed therein and a threaded fitting for a fuel line to a pressure monitor or a pressure regulator in the top of the rail adjacent the fuel inlet nipple, as seen in U.S. Pat. No. 4,519,368 (Hudson, Jr.). However, the aforementioned do not provide a unitary component for end closure and fuel inlet while also integrating a fuel parameter measurement mechanism therein, such as a fuel temperature sensor.

SUMMARY OF THE INVENTION

An object of the present invention is to provide a fuel temperature sensing device combined with a fuel rail end closure plug having a fuel inlet therein.

Another object of the present invention is to provide an closure for the end hole left by the core pin of a semi-solid forging process of a fuel rail.

An advantage of the present invention is that less parts are needed to accomplish the end closure and temperature sensing functions of a fuel supply manifold and thus manufacture is less costly.

Another advantage of the present invention is that engine assembly is made easier and quicker, and therefore less costly, since only one part need be attached to the fuel rail to accomplish the end closure, temperature sensing, and fuel inlet functions.

Still another advantage is that manufacture of a fuel rail is less complicated since no additional opening in the rail is required to accommodate the temperature sensor.

A feature of the present invention is a fuel rail end plug having a fuel inlet, a rail connection flange, a core insertable in the rail, and a temperature sensor and electrical connector housing integrally molded as a unitary component with a temperature sensor insert molded therewith.

These objects, advantages, and features are accomplished by providing a fuel injection supply manifold comprising fuel conduit means, such as a fuel rail, having a first end and a second end with first and seconds openings therein, respectively. A plurality of ports in the conduit means allows fluid communication with a plurality of fuel metering devices. End closure means, such as a plug, is mounted on the first end for providing closure of the first opening. The plug has a fuel inlet therethrough for introducing fuel to the fuel rail from a fuel source. Fuel temperature sensing means are integrally formed with the end closure means so as to sense the inlet temperature of fuel introduced to the conduit means. Connection means for connecting the plug to the rail comprises a plug flange extending perpendicularly to an axis through the fuel inlet for fixable attachment to a rail flange on the fuel rail, and a core projecting from the plug flange sealably insertable into the first opening for locating and sealing the plug therein.

The temperature sensing means preferably comprises an electronic temperature transducer, such as a thermocouple, positioned in close proximity to fuel flowing through the inlet to the fuel rail. The thermocouple has a pair of electrical terminals extending therefrom through the end plug so that the ends of the terminals do not contact fuel in the inlet. The terminals are surrounded by an electrical connector housing for mating with an electrical connector.

DETAILED DESCRIPTION OF THE PREFERRED EMBODIMENTS

Figure 1:
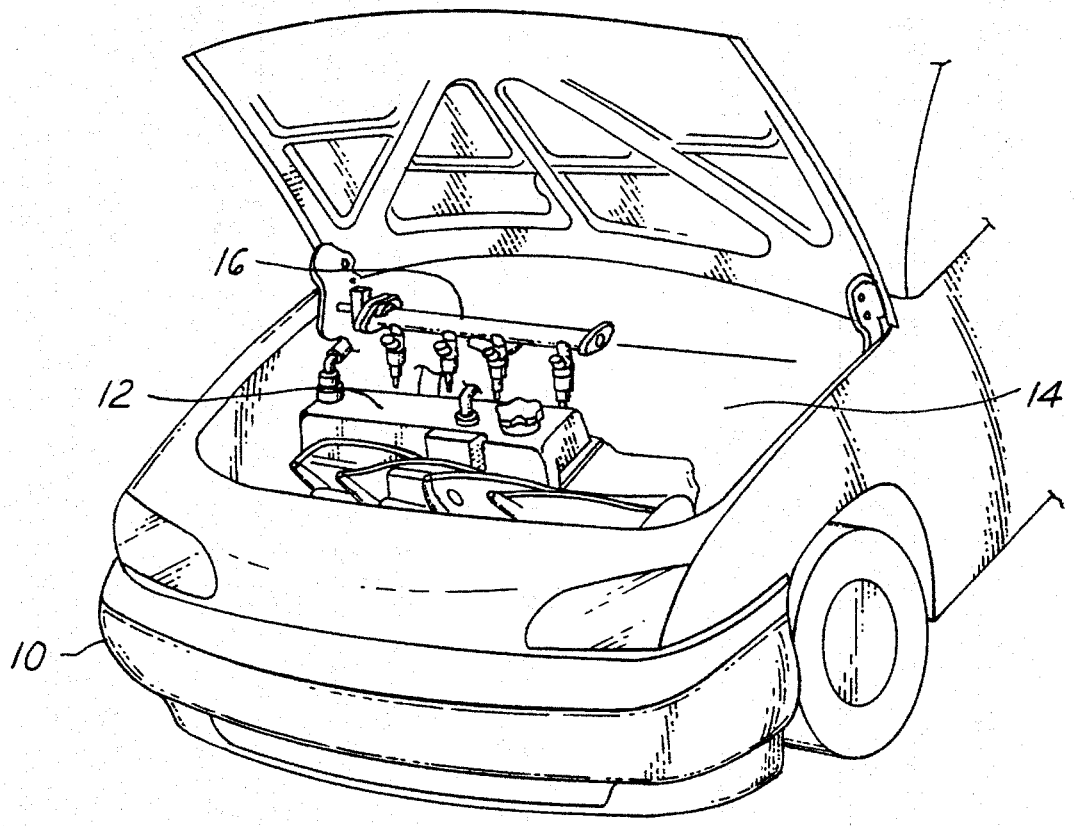
FIG. 1 is a perspective view of the underhood area of a vehicle showing an engine having a fuel rail with an end plug according to the present invention.

Referring now to the drawings, FIG. 1 shows vehicle 10 having internal combustion engine 12 in an underhood area 14. Fuel supply manifold 16 of the present invention is shown removed from, but proximate to, engine 12. Those skilled in the art will appreciate that manifold 16 is connected to engine 12 for delivering fuel thereto in a known manner, for example, through fuel injectors 18, and is shown removed for illustrative purposes only. Manifold 16 receives fuel from a fuel source (not shown), such as a fuel pump mounted in a fuel tank which pumps fuel through a fuel line connected to manifold 16.

Figure 2:
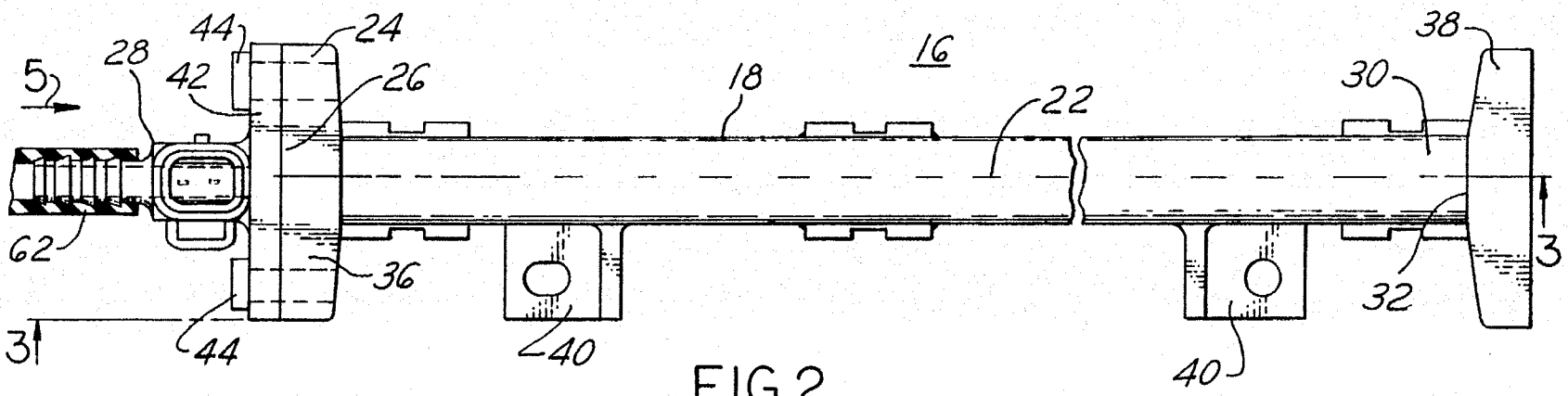
FIG. 2 is a top view of a fuel rail with an end plug of the present invention attached thereto.
Figure 3:
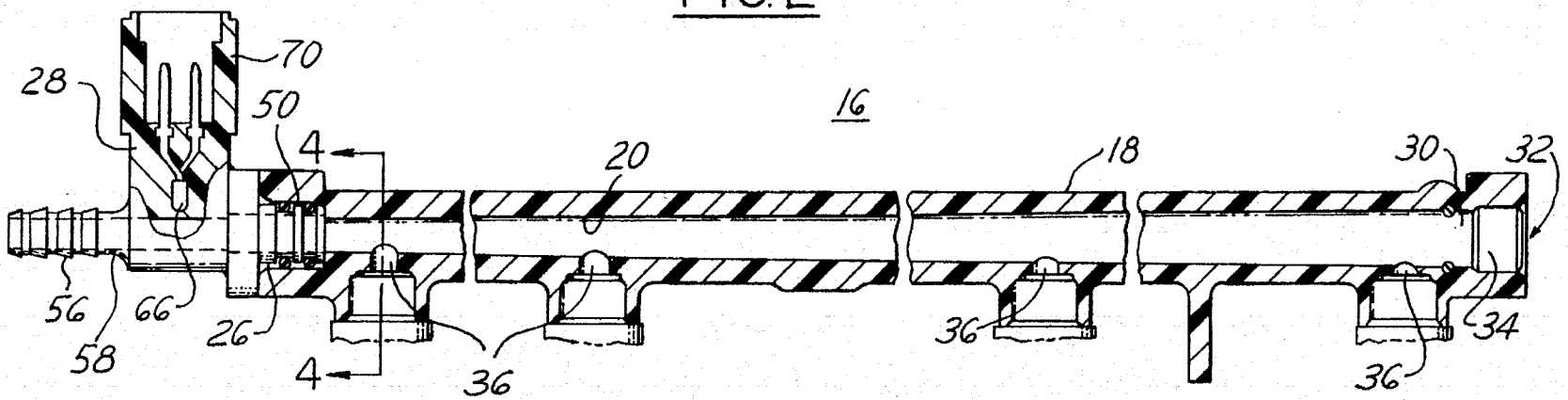
FIG. 3 is a side view of the fuel rail shown in FIG. 2.

Manifold 16 has fuel rail 18 with fuel carrying bore 20 therein directed along a generally longitudinal axis 22, as shown in FIGS. 2 and 3. Rail 18 can be made from metal, preferably a light weight metal such as aluminum, or from other materials, such as thermoplastics capable of retaining shape when exposed to high engine temperatures. Any of several known processes known may be employed to fashion rail 18, such as molding or extruding, but preferably a semi-solid forging process is used. As will be apparent to those skilled in the art, a core pin (not shown) is utilized around which the semi-solid material comprising rail 18 is formed. After the material solidifies, the core pin is removed thus leaving openings at both ends of rail 18. In one end, inlet end 24, is inlet opening 26 which is plugged with end plug 28 according to the present invention, as further described below. The other end 30 has opening 32 which is plugged by conventional end cap 34, for example a plug similar to those discussed above that completely obstruct opening 32 and prevent fuel leakage therethrough.

A pair of flanges 36 and 38 are forged on inlet end 26 and end 30, respectively, for attachment of rail 18 to end plug 28 and engine 12, respectively (FIG. 2). Connector brackets 40 extend radially from rail 18 for attachment to engine 12.

Figure 4:
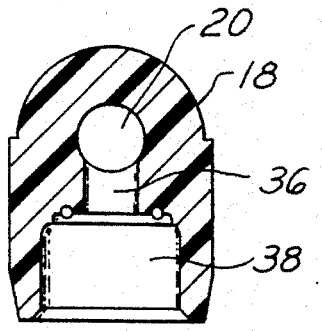
FIG. 4 is an end view of the fuel rail of FIG. 2.

As seen in FIG. 3, a plurality of fuel injector ports 36 are interposed between inlet end 26 and end 30 of fuel rail 18 for allowing fluid communication between bore 20 and a plurality of fuel metering devices (not shown), such as fuel injectors. Fuel injector port 36 connects bore 20 with fuel injector receiving cup 38 (FIG. 4).

Figure 5:
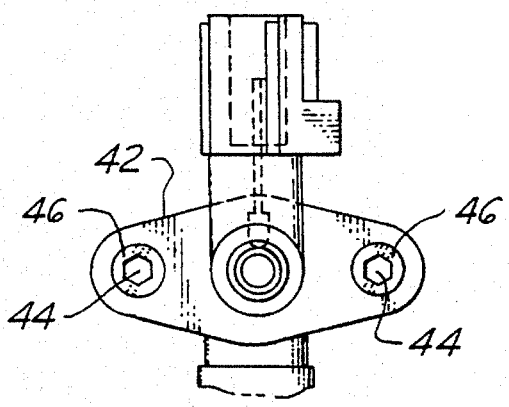
FIG. 5 is a cross-sectional view of a fuel rail of the present invention showing the fuel carrying bore with a port extending therefrom in fluid communication with a fuel injector receiving cup.
Figure 6:
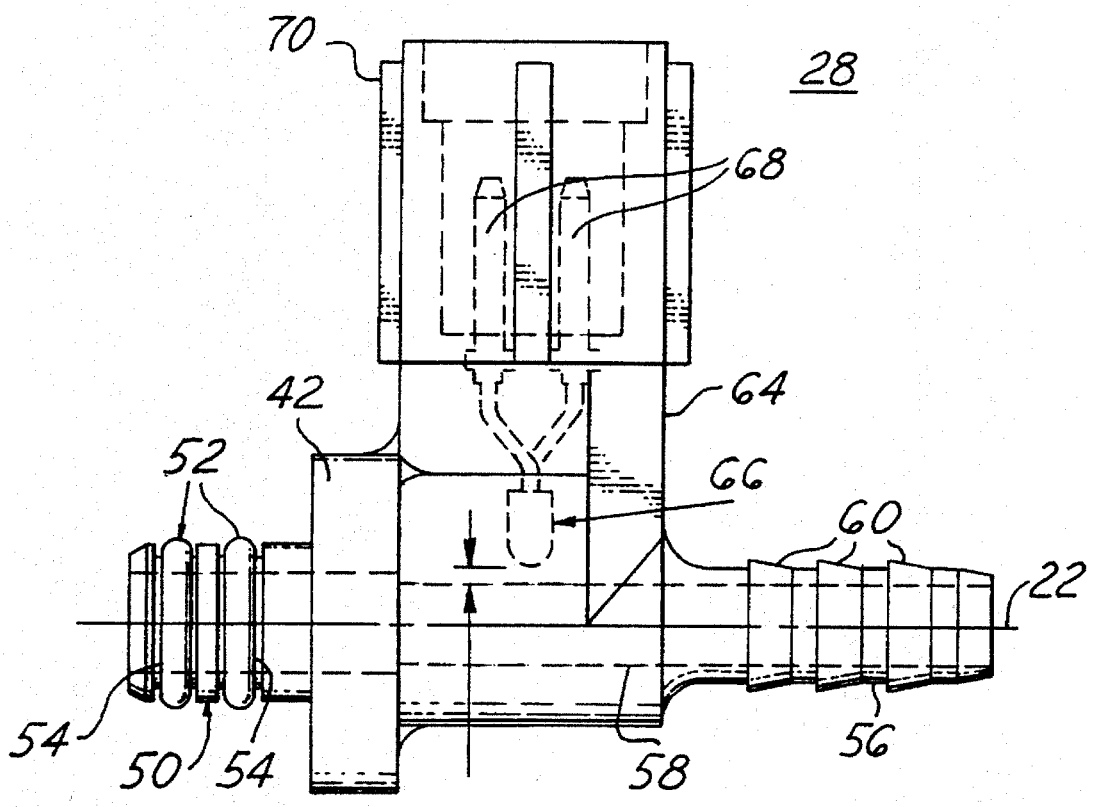
FIG. 6 is a side view of a fuel rail end plug according to the present invention showing a temperature sensing device integrally molded therein.

Turning now to FIGS. 5 and 6, an end plug 28 according to the present invention will be described. In FIG. 5, an end view of rail 18 is shown with end plug 28 mounted thereon for providing closure of inlet opening 26. End plug 28 has plug flange 42 extending therefrom perpendicular to longitudinal axis 22 for fixable attachment to flange 36 of fuel rail 18. Attachment to flange 36 is preferably accomplished by a pair bolts 44 which fit through bolt holes 46 in plug flange 42 and bolt holes 48 in flange 36 (FIGS. 2 and 5). Other means for connecting end plug 28 to rail 18 may also be used. End plug 28 also has core 50 projecting in a longitudinal direction from plug flange 42 along axis 22 and sealably inserts into inlet opening 26 for locating and sealing end plug 28 therein (FIGS. 3 and 6). O-rings 52 fit in grooves 54 to provide a seal between end plug 28 and rail 18.

End plug 28 has fuel inlet nipple 56 extending therefrom along longitudinal axis 22 on an opposite side of plug flange 42 from core 50 (FIG. 6). Fuel inlet 58 passes through nipple 56 for introducing fuel to bore 20 of fuel rail 18. On an outer periphery of nipple 56 are formed fir-tree style barbs 60 that accept and retain a fuel hose, such as an interference fit push-on fuel hose 62 (FIG. 2). Other types of hose connectors known to those skilled in the art may also be used, such as the spring-lock type coupling disclosed in U.S. Pat. Nos. 4,055,359 and 4,401,326, assigned to the assignee of the present invention, and incorporated by reference herein.

Located between fuel inlet nipple 56 and plug flange 42, and preferably integrally formed therewith, is housing 64 which contains a fuel temperature sensor, such as thermocouple 66 (FIGS. 3 and 6). Thermocouple 66 is positioned in close proximity to inlet 58, which extends through housing 64, so as to sense the inlet temperature of fuel introduced to fuel rail 18 without contacting or obstructing flow therethrough. For example, if housing 64 is made of a thermoplastic, such as Polyphenlyene Sulfide (PPS), then thermocouple 66 is located a distance of between approximately 0.5 to 2.0 millimeters, and preferably 1.0 millimeter, from inlet 58, as shown by distance D in FIG. 6. The advantageous location of thermocouple 66 in end plug 28 minimizes the temperature conductive effects of adjoining rail 18 and engine 12 components thereby providing a more accurate temperature measurement of incoming fuel.

As is also seen in FIG. 6, a pair of electrical leads 68 extend from thermocouple 66 through housing 64 for attachment to a conventional, two-prong female electrical connector (not shown). Electrical connector casing 70 surrounds leads 68 to guide the female electrical connector thereon.

Preferably, end plug 28 is molded of a thermoplastic material, such as PPS, using multidirectional core pulls to define plug flange 42 and mounting holes 46 therein. End plug 28 external geometry, including o-ring glands 54, sensor housing 64, electrical connector casing 70, fuel inlet nipple 56, and the internal fuel flow path geometry of inlet 58 would also be molded in a similar way. Those skilled in the art will appreciate in view of this disclosure that other forging and molding methods may also be employed to form end plug 28.

Although the preferred embodiment of the present invention has been disclosed, various changes and modifications may be made without departing from the scope of the invention as set forth in the appended claims.

We claim:

1. An automotive fuel injection supply manifold comprising:

a fuel rail having a first end and a second end, the ends having a first opening and a second opening therein, respectively;

a plurality of ports interposed between the ends of the fuel rail for allowing fluid communication with a plurality of fuel metering devices;

an end cap mounted on the second end for completely obstructing fuel flow through the second opening; and an end plug, mounted on the first end for providing closure of the first opening, having:

(1) a fuel inlet therethrough for introducing fuel to the fuel rail from a fuel source;

(2) a fuel temperature sensor integrally formed therewith so as to sense the inlet temperature of fuel introduced to the fuel rail, said fuel temperature sensor comprising a thermocouple positioned in close proximity to fuel flowing through the inlet to the fuel rail, the thermocouple having a pair of electrical terminals extending therefrom through the end plug so that the ends of the terminals do not contact fuel in the inlet, the terminals surrounded by an electrical connector housing for mating with the electrical connector;

(3) connection means for connecting the end plug to the fuel rail comprising a plug flange extending perpendicularly to an axis through the fuel inlet for fixable attachment to a rail flange on the fuel rail, and a core projecting from the plug flange sealably insertable into the first opening for locating and sealing the end plug therein; and wherein the fuel inlet, the flange, the core, and the electrical connector housing are a unitary component with the temperature tranducer insert molded therewith.

2. A fuel injection supply manifold according to claim 1 wherein said fuel inlet, said flange, said core, and said electrical connector housing are a unitary component made of a thermoplastic material with said temperature transducer insert molded therewith.

3. An automotive fuel injection supply manifold comprising:

a fuel rail having a first end and a second end, the ends having a first opening and a second opening therein, respectively;

a plurality of ports interposed between the ends of the fuel rail for allowing fluid communication with a plurality of fuel metering devices;

an end cap mounted on the second end for completely obstructing fuel flow through the second opening; and an end plug, mounted on the first end for providing closure of the first opening, having:

(1) a fuel inlet comprising a fir-tree style barb fitting having a duct therethrough in fluid communication with an interior portion of the fuel rail;

(2) a fuel temperature sensor integrally formed therewith so as to sense the inlet temperature of fuel introduced to the fuel rail, the sensor comprising a thermocouple positioned in close proximity to fuel flowing through the duct to the fuel rail and having a pair of electrical terminals extending therefrom through the end plug so that the ends of the terminals do not contact fuel in the inlet, the terminals also being surrounded by an electrical connector housing for mating with electrical connector; and (3) connection means for connecting the end plug to the fuel rail comprising a plug flange extending perpendicularly to an axis through the fuel inlet for fixable attachment to a rail flange on the fuel rail, and a core projecting from the plug flange sealably insertable into the first opening for locating and sealing the end plug therein.

* * * * *